US008905129B2

(12) United States Patent
Myers

(10) Patent No.: US 8,905,129 B2
(45) Date of Patent: Dec. 9, 2014

(54) SPEED ACTIVATED CLOSURE ASSEMBLY IN A TUBULAR AND METHOD THEREOF

(75) Inventor: William D. Myers, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 446 days.

(21) Appl. No.: 13/325,334

(22) Filed: Dec. 14, 2011

(65) Prior Publication Data

US 2013/0153212 A1 Jun. 20, 2013

(51) Int. Cl.
*E21B 33/06* (2006.01)

(52) U.S. Cl.
USPC ..... 166/250.01; 166/373; 166/64; 166/53; 175/40; 251/1.1

(58) Field of Classification Search
CPC ..... E21B 40/00; E21B 41/0021; E21B 33/06
USPC ..... 166/250.01, 373, 382, 298, 55, 55.1, 166/64, 65.1, 66, 53, 86.2, 86.3, 87.1; 251/1.1; 175/40
See application file for complete search history.

(56) References Cited

U.S. PATENT DOCUMENTS

| | | | | |
|---|---|---|---|---|
| 4,577,687 | A | 3/1986 | Lanmon, II | |
| 5,839,511 | A * | 11/1998 | Williams | 166/312 |
| 6,543,546 | B2 | 4/2003 | Kaiser | |
| 6,776,240 | B2 * | 8/2004 | Kenison et al. | 166/330 |
| 7,252,152 | B2 | 8/2007 | LoGiudice et al. | |
| 7,832,706 | B2 * | 11/2010 | Judge | 251/1.3 |
| 7,934,548 | B2 | 5/2011 | Doud et al. | |
| 2003/0089504 | A1 | 5/2003 | Parrott et al. | |
| 2004/0207539 | A1 | 10/2004 | Schultz et al. | |
| 2004/0226721 | A1 | 11/2004 | Feluch et al. | |
| 2005/0217365 | A1 | 10/2005 | Ekseth et al. | |
| 2005/0224229 | A1 * | 10/2005 | Blacklaw | 166/253.1 |
| 2009/0146835 | A1 | 6/2009 | Xu et al. | |
| 2010/0100329 | A1 | 4/2010 | Ekseth et al. | |
| 2010/0270464 | A1 | 10/2010 | Kalb | |
| 2012/0247770 | A1 * | 10/2012 | Roane et al. | 166/297 |

OTHER PUBLICATIONS

A. Andersen, Sintef Petroleum Research and A. Sivertsen, NTNU Department of Petroleum Engineering and Applied Geophysics, Downhole Blowout Preventer; paper prepared for presentation at 2001 SPE annual Technical Conference and Exhibit, New Orleans, Louisiana, Sep. 30-Oct. 3, 2001, SPE 71370; pp. 1-8.

International Search Report and Written Opinion; Date of Mailing Apr. 5, 2013, Korean Intellecutaly Property Office; International Appln No. PCT/US2012/069539; International Search Report 5 pges. Written Opinion 6 page.

* cited by examiner

*Primary Examiner* — Jennifer H Gay
*Assistant Examiner* — George Gray
(74) *Attorney, Agent, or Firm* — Cantor Colburn LLP

(57) ABSTRACT

A tubular closure assembly responsive to speed or velocity of an object. The tubular closure assembly includes at least one sensor in operable communication with an interior of a tubular. The at least one sensor sensing an object passing a first point and then a second point within the tubular. A processor receiving an output from the at least one sensor and calculating speed of the object from the first point to the second point. A control panel receiving information from the processor and a closure system movable between an open condition and a closed condition. Activatable to the closed condition by the control panel in response to the object moving from the first point to the second point at speed faster than a preset value or at a velocity outside a preset range. Also included is a method of closing a tubular of a borehole.

22 Claims, 5 Drawing Sheets

SPEED ACTIVATED CLOSURE ASSEMBLY IN A TUBULAR AND METHOD THEREOF

BACKGROUND

In the drilling and completion industry, the formation of boreholes for the purpose of production or injection of fluid is common The boreholes are used for exploration or extraction of natural resources such as hydrocarbons, oil, gas, water, and CO2 sequestration. A riser pipe may be fitted at the top of the borehole as a guide for a drill stem or as a conductor for drilling fluid. As tools are taken out through the riser pipe or introduced into the borehole through the riser pipe, some oil field operators have experienced a loss of tools and other equipment downhole when the tools and equipment are accidentally dropped, resulting in a loss of time trying to retrieve such dropped objects. Additionally, considerable expense may be suffered if the dropped object cannot be retrieved. It has been previously proposed to extrapolate a speed of a cable dropped into a well by monitoring rotation of wheels that pass the cable into the well or by monitoring the cable tension, however this approach requires direct contact with the cable and is limited to spooled devices.

Another extremely undesirable experience that needs to be prevented in the drilling and completion industry is a blowout. A blowout preventer ("BOP") is a safety valve installed in a well which may be manipulated between open and closed positions by variation of hydraulic pressure contained within a line extending from the safety valve to a control panel at a surface of the well. BOPs come in various configurations, including rams and annular preventers, and are often used in stacks. The BOP can be triggered by an electrical control signal via a cable extending from the rig, a "deadman" switch designed to automatically trigger the BOP if connection between the rig and the BOP is severed, and an acoustic control signal sent to the BOP from a surface location. In any case, the BOP is triggered when well fluids are required to be confined to the borehole. It has been previously proposed to employ slip rams of a blowout preventer to assist in the prevention of lost tubulars and tools downhole during their removal process, however this approach requires contact with the tubular or tool, is not based on the speed of the tubulars, and is limited to use during removal as it does not allow introduction into the well.

Accordingly, improvements for previous methodologies and configurations would be well received by the art.

BRIEF DESCRIPTION

A tubular closure assembly responsive to speed or velocity of an object, the tubular closure assembly includes at least one sensor in operable communication with an interior of a tubular, the at least one sensor sensing an object passing a first point and then a second point within the tubular; a processor receiving an output from the at least one sensor and calculating speed of the object from the first point to the second point; a control panel receiving information from the processor; and, a closure system movable between an open condition and a closed condition, and activatable to the closed condition by the control panel in response to the object moving from the first point to the second point at speed faster than a preset value or at a velocity outside a preset range.

A method of closing a tubular of a borehole, the method includes sensing an object location at a first point in the tubular; sensing the object location at a second point in the tubular; calculating a speed of the object from the first point to the second point; and activating a closure system from an open condition to a closed condition if the speed exceeds a selected value or if a velocity of the object is outside a selected range.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
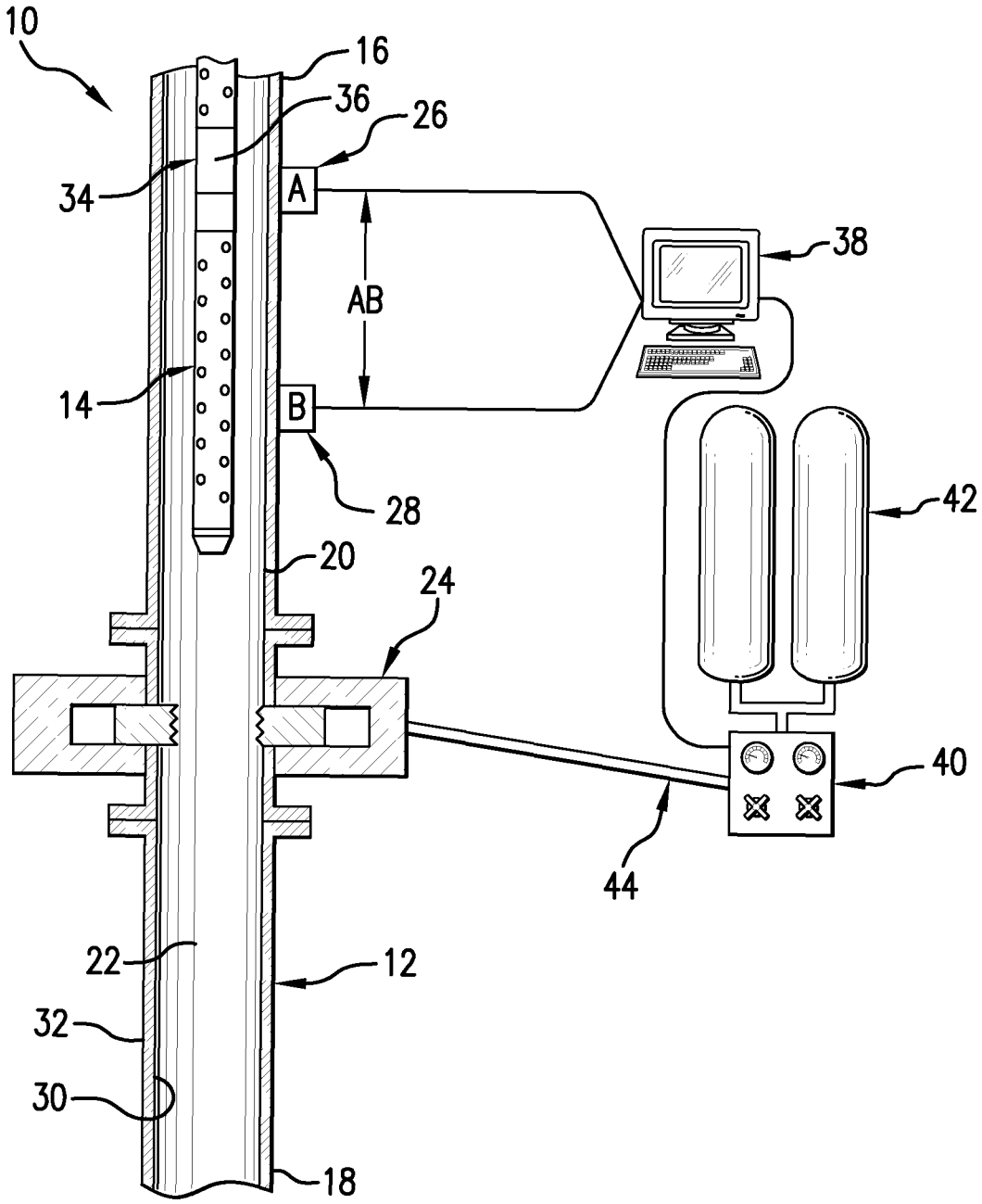
FIG. 1 depicts a schematic and cross sectional view of an exemplary embodiment of a speed activated closure assembly.

As shown in FIG. 1, in one exemplary embodiment, a speed activated closure assembly 10 includes a tubular 12. Although the closure assembly 10 may be incorporated with any tubular along the length of a borehole, the closure assembly 10 is most advantageously incorporated within a riser, at an uphole end of the borehole. Incorporation within a riser prevents a dropped object, such as object 14, from traveling downhole further into the borehole, simplifying the retrieval of the dropped object 14. However, the closure assembly 10 is also installable further downhole the borehole, i.e. downhole of a riser, to prevent an object 14, such as a well tool that is in use, from falling further downhole into a casing, sleeve, or other tubular. A plurality of the closure assemblies 10 may be provided at various locations along a string as required. The portion of the tubular 12 depicted in FIG. 1 includes an uphole end 16 and a downhole end 18, although it should be understood that the tubular 12 may extend further uphole than shown and further downhole than shown. The tubular 12 includes a tubular wall 20, which in most cases has a substantially circular cross-section, although not limited thereto. The tubular wall 20 surrounds a passageway 22 for the object 14 to pass, as well as for passing drilling fluid or wellbore fluid. The passageway 22, under normal operational circumstances, remains substantially obstruction-free.

The closure assembly 10 further includes a closure system 24 that is triggerable to shut the passageway 22 of the tubular 12 when an object 14 moves downhole at a certain speed that exceeds, or is otherwise outside of a range, of a programmed limit. Thus, the prevention of dropped objects during coiled tubing, EWL, completions and drilling operations within risers and blow out preventers ("BOPs") is provided by the closure assembly 10. In ordinary use, the closure system 24 will remain in an open or non-obstructing condition so that tools or other objects 14 can pass freely in and out of the tubular 12, as well as fluids.

In order to detect the speed of a passing object 14, two sensor devices 26, 28 are provided on the tubular 12 at a location prior to the object 14 passing the closure system 24. By "on" the tubular 12, it should be understood that the sensor devices 26, 28 may be located on a manifold on the tubular 12 or otherwise connected to the tubular 12. Depending on the type of sensors employed in the sensor devices 26, 28, the sensor devices 26, 28 may be positioned on an interior surface 30 of the tubular wall 20, on an exterior surface 32 of the tubular wall 20, or within the tubular wall 20 itself, such as in a pocket or opening in the tubular wall 20 to protect the sensor devices 26, 28 from accidental dislodgement. The sensor devices 26, 28 are provided uphole of the closure system 24, closer to the uphole end 16 of the tubular 12 than the downhole end 18 of the tubular 12. The sensor devices 26, 28, positioned at points A and B along the tubular 12 respectively, are spaced a longitudinal distance "AB" apart from each other. The first sensor device 26 is located further uphole than the second sensor device 28, so that the object 14 is first detected by the first sensor device 26 as the object 14 passes the first point A and then after a period of time by the second sensor device 28 as the object 14 passes the second point B, where the period of time depends on the distance AB and the speed of the object 14. The type of sensor devices 26, 28 employed on the tubular 12 cooperates with the objects 14 that are passing within the tubular 12 that are run into and out of the wellbore.

Objects 14 running into and out of the tubular 12 include, but are not limited to, tubing-conveyed perforating ("TCP") guns, coiled tubing, EWL, and other tools associated with completions and drilling operations. In an exemplary embodiment, the objects 14 incorporate a sub 34 that contains an emitter 36. The emitter 36 may include radio frequency identification ("RFID"), or may emit detectable signals such as radioactive ("RA"), magnetic, acoustic, light or optics, etc. The sensor devices 26, 28 employed in the closure assembly 10 would thus respectively detect the RFID tag, RA signal, metal or magnetic field, sound waves, light or optical waves, etc. that are emitted from the emitter 36. RFID tags are easily employed as they can be applied to nearly any object 14. In an RFID embodiment, the sensor devices 26, 28 are positioned on the interior surface 30 of the tubular 12 or within the tubular wall 20 as long as the sensor devices 26, 28 are within full range of the radio waves from the RFID, since radio waves emitted by the RFID will not be able to escape through the tubular 12, assuming it is metal, because a metal tubular is a radio wave inhibiting structure. The emitter 36 may be capable of broadcasting a signal such as an acoustic signal, a magnetic field, a gamma wave signal, a recording (such as a voice), etc. The signal may be continuously broadcast, on a timer, may begin at a selected depth, may begin when contact is made with a certain chemical, when another field is encountered, upon receiving a certain start (or stop) signal, and could be configured to operate utilizing a combination of these or combinations including at least one of the foregoing. The emitter 36 utilizes a wireless signal to communicate with the sensor devices 26, 28. If necessary, the sub 34 includes an on board power source to drive the emitter 36. The source may be a battery or may be a pressure based energy source or electrochemically based energy source.

Depending on the emitter 36, the sensor devices 26, 28 may employ one of a magnet/electromagnet sensor to sense a metal moving past, a proximity sensor that detects the proximity of an object without physical contact, an induction sensor that detects metallic objects, a photo electric sensor that uses light sensitive elements to detect objects, and a capacitive sensor that detects metallic and non-metallic objects. The type of sensor devices 26, 28 chosen are those types capable of detecting the emitted medium from the emitter 36. For example, the sensor devices 26, 28 are optical if the emitter 36 is light.

In an alternative exemplary embodiment, the object does not include any particular emitting property, and the sensor devices 26, 28 sense the passing object by changes in light, acoustics, magnetic induction, etc. as the object passes. This is helpful when the dropped object is not tagged or otherwise outfitted with an emitter, such as a dropped wrench or the like. While two sensor devices 26, 28 have been described on the tubular 12, in another alternative exemplary embodiment, a single sensor device includes a speed detector such as laser gun speed detector that can take many samples by shooting short bursts of infrared laser light that reflect off of the passing object 14 and compare the change in distance between samples to calculate the speed of the object. The speed detector is alternatively a radar gun speed detector, which transmits a microwave pulse, and the frequency of the transmitted pulse is compared to the frequency of the reflection, and the difference between the two frequencies is used to calculate the speed. A separate sensor may be used to trigger initiation of the speed detector within the sensor device. In such an embodiment, sensor device 26 may be an initiating sensor while sensor device 28 includes a speed detector.

A programmable/preprogrammed microprocessor/controller, hereinafter referred to as a "computer" 38, is connected to the sensor devices 26, 28 and programmed to allow the object 14 to move at a pre-established "allowed rate" through the passageway 22 of the tubular and past the closure system 24, likely the typical running speed of the tools. Should the object 14 be dropped, the sensor devices 26, 28 will detect the emitted signal from emitter 36 or otherwise detect the passage of the object 14, the computer 38 will calculate the time it takes the object 14 to pass from point A to point B over the distance AB, and compare that time to the allowed running rate. If the allowed rate is exceeded, the computer 38 triggers a control panel 40 connected to the closure system 24. The computer 38 may also be responsive to the velocity (speed in a given direction) of the passing object 14 and may activate the closure system 24 by a change in velocity outside a preset range, or by a change in the direction of the passing object 14. For example, if an object 14 is being removed from the tubular 12 in an uphole direction and then it is dropped, the velocity of the object 14, which will indicate that the object 14 is now moving in the downhole direction, will trigger the closure system 24.

In an exemplary embodiment, the computer 38 is coupled to a manifold/control panel 40 for an accumulator "koomey" unit 42. The accumulator 42 is plumbed to the closure system 24. Manipulation of the closure system 24 from an open to a closed position may be accomplished by a variation of hydraulic pressure contained within a line 44 extending from the closure system 24 to the control panel 40. When the control panel 40 sends a signal to activate the closure system 24, a variation in hydraulic pressure is sent to the closure system 24, which manipulates the closure system 24 to a closed position. The computer 38 may be programmed to delay a closing of the closure system 24 until after a workstring, such as a gravel pack assembly, is purposefully dropped from a rig floor. Also, the sensor devices 26, 28 may be arranged to sense certain objects but not others, such that some objects may be purposefully dropped and pass freely through the tubular 12, while others trigger a sensor in the sensing devices 26, 28 which lead to a closing of the closure system 24.

Figure 2:
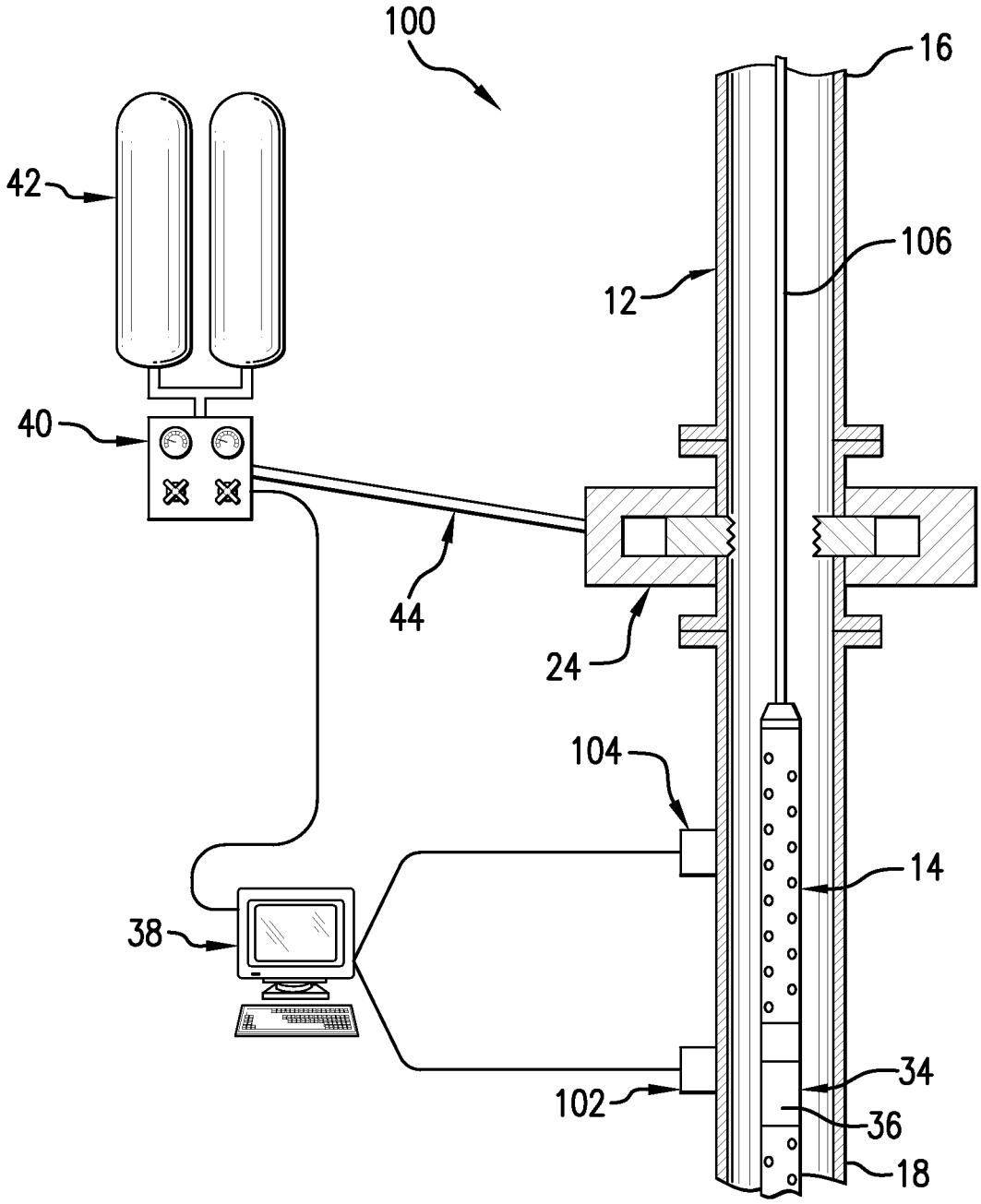
FIG. 2 depicts a schematic and cross sectional view of another exemplary embodiment of a speed activated closure assembly.

Turning to FIG. 2, in another exemplary embodiment, a speed activated closure assembly 100 is similar to the speed activated closure assembly 10 shown in FIG. 1 except that instead of sensor devices 26, 28 positioned uphole of the closure system 24, sensor devices 102, 104 are positioned downhole of the closure system 24 to prevent objects from departing the tubular 12 at a speed in excess of a preset limit, thus preventing projectiles from being launched out of the tubular 12. The tubular 12 includes an uphole end 16 and a downhole end 18, and the object 14 moves from the downhole end 18 towards the uphole end 16, such as by being pulled by a cable 106. The object 14 may include an emitter 36 on a sub 34 for sensing by the sensor devices 102, 104, or the sensor devices 102, 104 may include alternate sensors for otherwise detecting passage of the object 14 as previously described. The first sensor device 102 is positioned closer to the downhole end 18, and the second sensor device 104 is positioned uphole of the first sensor device 102, and between the first sensor device 102 and the closure system 24. When the object 14 passes the first sensor device 102 and then the second sensor device 104, the computer 38 processes the speed of the object 14 and notifies the control panel 40 to close the closure system 24 if the object 14 is moving through the tubular 12 at an unacceptable speed.

Figure 3:
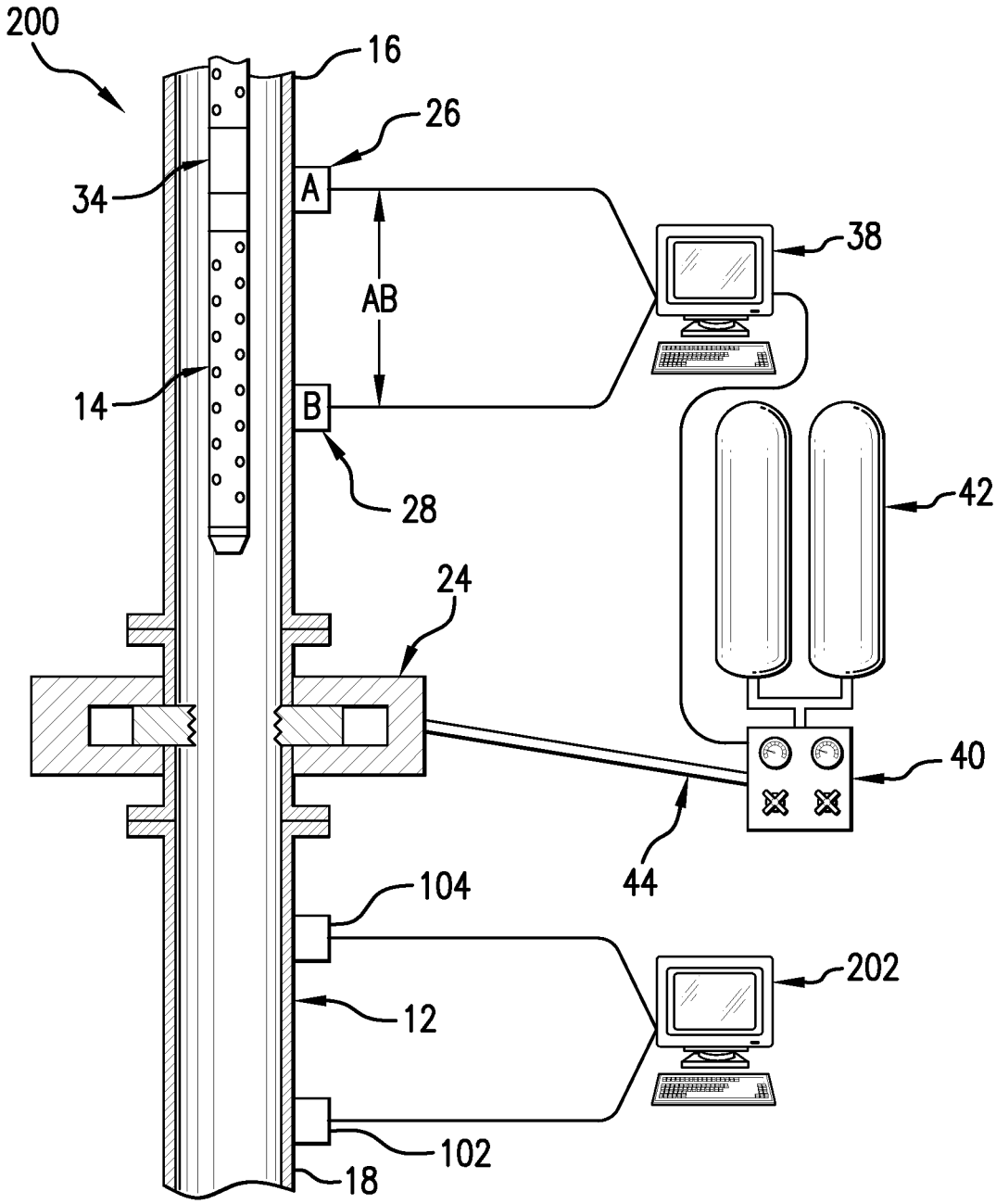
FIG. 3 depicts a schematic and cross sectional view of yet another exemplary embodiment of a speed activated closure assembly.

Turning to FIG. 3, in yet another exemplary embodiment, a speed activated closure assembly 200 is similar to both the speed activated closure assembly 10 shown in FIG. 1 and the speed activated closure assembly 100 shown in FIG. 2, except that the speed of the object 14 is detected both uphole and downhole of the closure system 24 using first and second sensor devices 26, 28 and third and fourth sensor devices 102, 104, respectively. The closure assembly 200 is thus employable in catching a dropped object 14 as well as preventing an object 14 from being ejected from the tubular 12. A second computer 202 is shown for computing the speed of the object 14 passing by the third and fourth sensor devices 102, 104, however a single computer 38 may alternatively be used for the first and second sensor devices 26, 28 as well as for the third and fourth sensor devices 102, 104.

The closure system 24 may include a dedicated valve assembly that is similar in construction to that of a blowout preventer ("BOP"). While BOPs are normally used to seal or otherwise control oil or gas wells to prevent tubing, tools, and fluid from being blown out of a wellbore during a blowout, a BOP employed in the speed activated closure assembly 10, 100, or 200 is triggered when an object 14 is detected by the pair of sensors 26, 28 or 102, 104 going a speed that is greater than an allowed rate, thus preventing the object 14 from falling into the tubular 12 or being too quickly ejected from the tubular 12.

Figure 4:
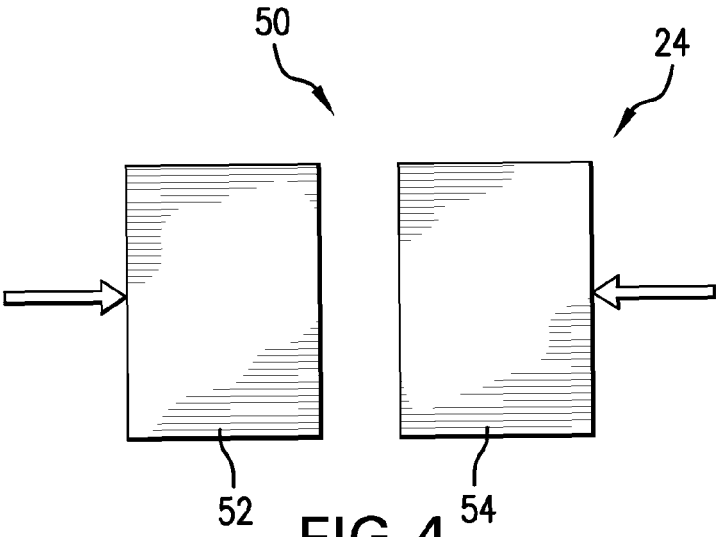
FIG. 4 depicts a top plan view of an exemplary embodiment of a pair of blind ram blocks for a closure system.
Figure 5:
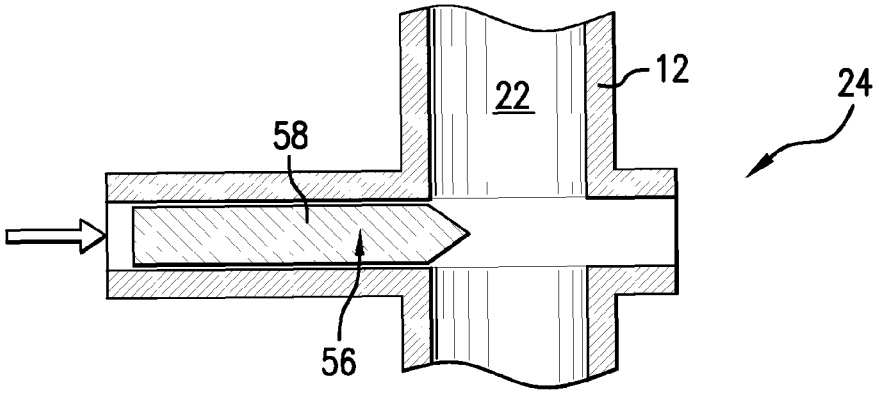
FIG. 5 depicts a side cross-sectional view of an exemplary embodiment of a single blind ram block for a closure system.

FIGS. 4-9 show various embodiments of the closure system 24 usable in the closure assemblies 10, 100, 200. As shown in FIG. 4, in one exemplary embodiment, the closure system 24 is a full close "blind ram" 50, such as a sliding gate of a gate valve that has no hole, space, or cutouts therein. The blind ram 50 shown in FIG. 4 includes first and second plates 52, 54 that are pushed together in opposite directions to close the passageway 22 of the tubular 12. Alternatively, as shown in FIG. 5, a blind ram 56 includes a single plate 58 that closes the tubular passageway 22 from one side to the other. In either embodiment shown in FIGS. 4 and 5, the blind ram 50, 56 may be modified to be a shear ram by including a sharpened edge to slice through a cable, wireline, or other tool passing through the tubular 12.

Figure 6:
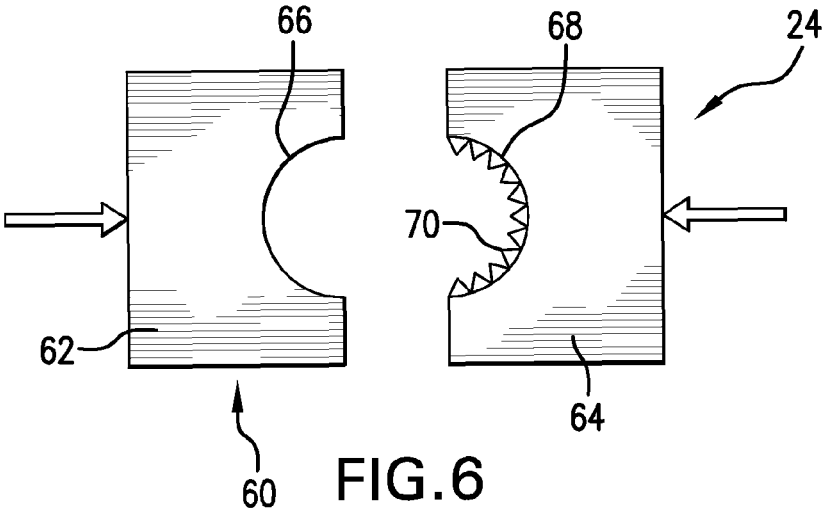
FIG. 6 depicts a top plan view of an exemplary embodiment of a pair of gripper blocks for a closure system.

In another exemplary embodiment shown in FIG. 6, the closure system 24 includes a "slip/grip" design to grab the outer diameter of the object and slow it to a stop. While various gripper designs are usable within the closure system 24 herein, the gripper design shown in FIG. 6 is a slip ram 60 that uses first and second ram blocks 62, 64 that each include a semicircular cutout 66, 68, respectively, that defines a bore when the ram blocks 62, 64 are closed together. One or both of the cutouts 66, 68 may include slips 70 that engage with the falling object to prevent it from dropping further down the tubular 12. Other gripping surfaces can be provided on the ram blocks 62, 64, and the cutouts 66, 68 may be variously sized to cooperate with the object that is being passed therethrough.

Figure 7:
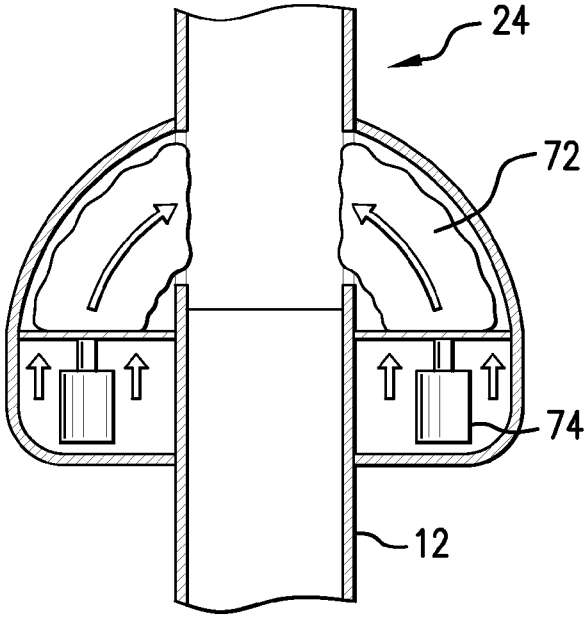
FIG. 7 depicts a side cross-sectional view of an exemplary embodiment of an elastomeric packing member for a closure system.

FIG. 7 shows another exemplary embodiment of a closure system 24, this one employing an annular shaped elastomeric packing member 72 positioned between the tubular 12 and a hydraulic piston 74 that, when activated, forces the packing member 72 into the tubular 12 to fill the tubular 12 and prevent further movement of a speeding object, or surrounds the speeding object to stop its further motion.

Figure 8:
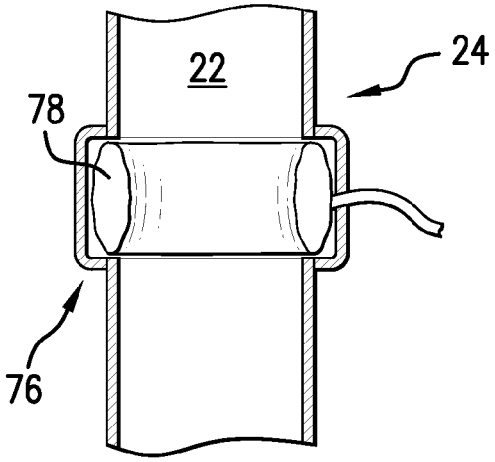
FIG. 8 depicts a side cross-sectional view of an inflatable annular reverse annular bag for a closure system; and, FIG. 9 depicts a side cross-sectional view of a flapper valve for a closure system.

FIG. 8 shows still another exemplary embodiment, where the closure system 24 is that of an inflating "reverse annular" bag 78, such as an inflatable donut-shaped annular preventer 76 that is triggered to inflate and either surround the falling object to stop its further motion, or fill the passageway 22 to catch the dropped object.

Figure 9:
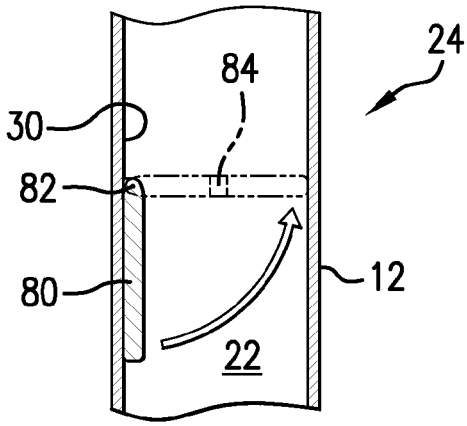

In yet another exemplary embodiment shown in FIG. 9, the closure system has a flapper type construction. The flapper 80, such as a flapper valve, is held against an interior wall 30 of the tubular 12 until the closure system 24 is activated, at which time the flapper 80 is pivoted either downwardly or upwardly, depending on the pivot point 82 location, to close the tubular 12. The flapper 80 may further include a slot 84 for wireline cable to pass in a tool-catcher style when the flapper 80 is in a closed position blocking the passageway 22.

In any of the above-described embodiments, instead of completely closing the tubular passageway 22, the closure system 24 may instead be designed or instructed by the computer 38 and control panel 40 to only partially close a portion of the passageway 22, such that a shoulder is formed within the passageway 22, but a fluid passageway is still enabled. That is, the rams 50, 56, 60 shown in FIGS. 4 to 6 and the packing member 72 shown in FIG. 7 may be pushed only partially into the passageway 22 such that a shoulder is formed. Likewise, the inflatable annular donut 78 of FIG. 8 and the flapper 80 of FIG. 9 may be constructed with reduced dimensions to provide a partial obstruction within the tubular passageway 22 rather than blocking an entire cross-sectional area of the passageway 22 when the closure system 24 is activated to a closed condition. In an exemplary embodiment, a shoulder movable between an open condition and a closed condition may be positioned further downhole from a riser to catch a dropped fish at a predetermined location.

After the object 14 has been halted by the closure system 24, the computer 38, 202 may send a signal to the control panel 40 to re-open the closure system 24, such as after the object 14 has been recovered after being dropped, or after it is determined that the object 14 will not eject from the tubular 12 if the closure system 24 is re-opened.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A tubular closure assembly responsive to speed or velocity of an object, the tubular closure assembly comprising:

at least one sensor in operable communication with a passageway in an interior of a tubular, the at least one sensor sensing an object passing a first point and then a second point within the passageway of the tubular;

a processor receiving an output from the at least one sensor and calculating speed of the object from the first point to the second point;

a control panel receiving information from the processor; and, a closure system movable between an open condition allowing passage of the object through the passageway and past the closure system and a closed condition configured to block the passageway of the tubular and prevent further progress of the object through the passageway, the closure system activatable to the closed condition by the control panel in response to the object moving from the first point to the second point at speed faster than a preset value or at a velocity outside a preset range.

2. The tubular closure assembly of claim 1, further comprising a detectable portion on the object passing through the tubular, the detectable portion emitting a signal sensed by the at least one sensor.

3. The tubular closure assembly of claim 2, wherein the detectable portion is an RFID tag.

4. The tubular closure assembly of claim 2, wherein the signal is radioactive, acoustical, optical or magnetic.

5. The tubular closure assembly of claim 1, wherein the at least one sensor includes a first sensor at the first point and a second sensor at the second point, the second point spaced longitudinally apart from the first point.

6. The tubular closure assembly of claim 1, wherein the closure system includes a blind ram.

7. The tubular closure assembly of claim 1, wherein the closure system includes a flapper valve.

8. The tubular closure assembly of claim 1, wherein the closure system includes an inflatable reverse annular bag.

9. The tubular closure assembly of claim 1, wherein the closure system includes at least one gripper ram block having a cutout capable of engaging an outer surface of the object.

10. The tubular closure assembly of claim 9, wherein the at least one gripper ram block includes slips.

11. The tubular closure assembly of claim 1, wherein the closure system is a dedicated blowout preventer.

12. The tubular closure assembly of claim 1, wherein the second point is further downhole than the first point, and the closure system is activated in response to the object falling in the tubular.

13. The tubular closure assembly of claim 1, wherein the first point is further downhole than the second point, and the closure system is activated in response to the object ejecting from the tubular.

14. The tubular closure assembly of claim 1, wherein the closure system includes a closure portion sized to substantially block the passageway of the tubular in the closed condition.

15. The tubular closure assembly of claim 1, wherein the control panel limits movement of a closure portion of the closure system to a partial obstruction of the passageway to form a shoulder with the closure portion.

16. The tubular closure assembly of claim 1 wherein the tubular is a riser.

17. The tubular closure assembly of claim 1, wherein the closure system includes an aperture sized to accept wireline cable when the closure system is in the closed condition.

18. The tubular closure assembly of claim 1, wherein the at least one sensor is mounted on the tubular.

19. A method of closing a tubular of a borehole, the method comprising:

sensing an object location at a first point in a passageway of the tubular;

sensing the object location at a second point in the passageway of the tubular;

calculating a speed of the object from the first point to the second point; and activating a closure system from an open condition allowing passage of the object through the passageway and past the closure system to a closed condition configured to block the passageway of the tubular and prevent further progress of the object through the passageway if the speed exceeds a selected value or if a velocity of the object is outside a selected range.

20. The method of claim 19, further comprising delaying activation of the closure system for an interval of time and purposefully dropping a workstring during the interval of time.

21. The method of claim 19, wherein activating the closure system includes activating a dedicated blowout preventer.

22. The method of claim 19, wherein the second point is further downhole than the first point and closing the tubular includes catching a dropped object.

* * * * *